US007794179B2

(12) United States Patent
Nakako et al.

(10) Patent No.: US 7,794,179 B2
(45) Date of Patent: Sep. 14, 2010

(54) ROCKBOLT OF HIGH STRENGTH STEEL PIPE AND METHOD OF MANUFACTURING THE SAME

(75) Inventors: Takefumi Nakako, Amagasaki (JP); Takeyuki Yoshida, Amagasaki (JP); Shigeo Matsubara, Chiyoda-ku (JP); Toshiharu Kittaka, Chuo-ku (JP); Hiroki Kanazawa, Chuo-ku (JP)

(73) Assignee: Nisshin Steel Co., Ltd., Tokyo (JP)

( * ) Notice: Subject to any disclaimer, the term of this patent is extended or adjusted under 35 U.S.C. 154(b) by 748 days.

(21) Appl. No.: 10/586,088

(22) PCT Filed: Jul. 29, 2004

(86) PCT No.: PCT/JP2004/011205

§ 371 (c)(1),
(2), (4) Date: Jul. 13, 2006

(87) PCT Pub. No.: WO2005/068779

PCT Pub. Date: Jul. 28, 2005

(65) Prior Publication Data

US 2008/0107488 A1 May 8, 2008

(30) Foreign Application Priority Data

Jan. 14, 2004 (JP) ..... 2004-007046

(51) Int. Cl.
*E21D 21/00* (2006.01)

(52) U.S. Cl. ..... 405/259.3

(58) Field of Classification Search ... 405/259.1–259.6; 411/19

See application file for complete search history.

(56) References Cited

U.S. PATENT DOCUMENTS

| | | | | |
|---|---|---|---|---|
| 4,509,889 | A * | 4/1985 | Skogberg et al. | 411/19 |
| 4,511,289 | A * | 4/1985 | Herron | 405/259.3 |
| 4,636,115 | A * | 1/1987 | Davis et al. | 405/259.4 |

FOREIGN PATENT DOCUMENTS

| | | |
|---|---|---|
| CA | 1 233 037 | 2/1988 |
| CA | 2 368 506 | 9/2001 |
| GB | 2 072 784 A | 10/1981 |
| JP | 63-185900 | 11/1988 |
| JP | 64-043700 | 2/1989 |
| JP | 07-189598 | 7/1995 |
| JP | 2003-501573 | 1/2003 |
| JP | 2003-145216 | 5/2003 |
| JP | 2003-206698 | 7/2003 |

* cited by examiner

*Primary Examiner*—Sunil Singh
(74) *Attorney, Agent, or Firm*—The Webb Law Firm

(57) ABSTRACT

A high-strength steel pipe rockbolt has an expansive rockbolt main body prepared by processing a high-strength steel sheet of 1.8-2.3 mm in thickness with a tensile strength of 490-640 N/mm$^2$ and an elongation of 20% or more into a welded pipe and roll-forming the welded pipe into a shaped pipe having one or more concavities extending along an axial direction. Use of the high-strength steel sheet ensures sufficient strength of the shaped pipe regardless of a decrease in thickness. The thin welded pipe is also advantageous in resistance to cracking caused by accumulation of strains introduced during roll-forming, swaging both ends of the welded pipe and hydraulic expansion. Moreover, expansive deformation of the shaped pipe is initiated by injection of a pressurized fluid at a low pressure, so that the expansive deformation is completed in a short time period with an improved working efficiency.

9 Claims, 5 Drawing Sheets

ROCKBOLT OF HIGH STRENGTH STEEL PIPE AND METHOD OF MANUFACTURING THE SAME

BACKGROUND OF THE INVENTION

1. Field of the Invention

The present invention relates to a high-strength steel pipe rockbolt, which is firmly fixed to a bedrock or ground in a state radially expanded by a hydraulic pressure, and a method of manufacturing thereof.

2. Description of Related Art

A steel pipe rockbolt, which is firmly fixed to a bedrock or ground in an expanded state, is manufactured from a hollow shaped pipe having one or more expansive concavities extending in an axial direction. The steel pipe rockbolt 1 has a sealed end, which is inserted into a rockbolt-setting hole formed in a bedrock or ground 2, as shown in FIG. 1. There is a vacancy between the rockbolt-setting hole and the un-expanded steel pipe rockbolt 1 (FIG. 2A). The steel pipe rockbolt 1 is expanded by a hydraulic pressure (FIG. 2B) provided by the hydraulic pump 3, and finally pressed onto an inner wall of the rockbolt-setting hole (FIG. 2C). Consequently, the bedrock or ground 2 is reinforced with the rockbolt 1.

A shaped pipe with at least an expansive concavity 4, which extends along an axial direction, has been used as an expansive rockbolt, in order to facilitate expansion by a hydraulic pressure. The shaped pipe has hermetically sealed top and rear ends and a hole for introduction of a pressurized fluid at its side wall. A shaped steel pipe, which has sleeves fixed to its both ends for introduction of a pressurized fluid, is also disclosed in JP 2003-501573 A.

For standardization of labors and saving of labor costs in construction sites such as tunnels, many rockbolt-setting holes of the same size are drilled in a bedrock or ground 2, and steel pipe rockbolts of the same diameter are placed in the rockbolt-setting holes. For instance, a shaped pipe, which is formed from a steel pipe of 54 mm in outer diameter to a profile having an outer diameter of 36 mm and a concavity 4, is placed in a rockbolt-setting hole of 45-50 mm in size and firmly fixed to a bedrock or ground 2 by hydraulic expansion.

The expansive steel pipe rockbolts are classified to a 110 kN group and a 170 kN group by the yield strength necessary for construction conditions, e.g. competence and geomechanics of a bedrock or ground as well as cross-sectional profiles of tunnels. Rockbolts, which belong to the 110 kN group, are manufactured from steel sheets of 2 mm in thickness with a tensile strength of 300 N/mm$^2$ or more and a total elongation of 30% or more. Rockbolts, which belong to the 170 kN group, are manufactured from steel sheets of 3 mm in thickness with a tensile strength of 300 N/mm$^2$ or more and a total elongation of 35% or more. In any case, the steel sheet is formed to a cylindrical pipe of 54 mm in outer diameter and further reformed to a shaped pipe of 36 mm in outer diameter with a concavity 4.

The shaped pipe is manufactured by partially bending a cylindrical pipe with a small bending radius in a sectional plane, as shown in FIG. 2A. On the presumption that shaped pipes have the same outer diameter, a bending radius at a center is smaller as a thickness is increased for a steel sheet, which is formed to a shaped pipe. The shaped pipes are further swaged at its both ends, since sleeves having inner and outer diameters regularized in size are fixed to the end parts of the shaped pipes. A thicker steel sheet is reformed with a smaller bending radius even in the swaging process. That is, a local bending radius becomes smaller as aria thickness increase of a steel sheet for raising strength of a rockbolt.

By the way, many strains are introduced into a steel sheet in a pipe-making process, a pipe-shaping process and a swaging process. Strains are also accumulated during hydraulic expansion of a shaped pipe. When the shaped pipe is further expanded, it is often cracked due to the introduction of additional strains. Cracking causes leakage of a pressurized fluid, insufficient expansion of the shaped pipe and a shortage of the strength necessary for a rockbolt.

SUMMARY OF THE INVENTION

The present invention aims at providing high-strength steel pipe rockbolts with high reliability. An object of the invention is to inhibit cracking of rockbolts, which are induced by strains introduced in a pipe-shaping process, a swaging process and a hydraulically expanding process. Another object of the invention is to initiate expansive deformation of the shaped pipe at a relatively lower pressure during hydraulic expansion and to complete the expansive deformation in a short time period.

The invention proposes a high-strength steel pipe rockbolt, comprising an expansive rockbolt main body formed from a shaped pipe having one or more concavities extending along an axial direction. The shaped pipe is manufactured from a high-strength steel sheet of 1.8-2.3 mm in thickness with a tensile strength of 490-640 N/mm$^2$ and an elongation of 20% or more. The shaped pipe preferably has a tensile strength of 530-690 N/mm$^2$ and an elongation of 20% or more.

The material of the rockbolt may be a high-strength steel sheet coated with a Zn, Zn—Al or Zn—Al—Mg plating layer. The plating layer is present on a surface of the shaped pipe after being roll-formed and protects a rockbolt, which is embedded in a bedrock or ground, from a corrosive atmosphere.

The inventive steel pipe rockbolt is manufactured by the following steps:

(1) A step of forming a high-strength steel sheet of 1.8-2.3 mm in thickness with a tensile strength of 490-640 N/mm$^2$ and an elongation of 20% or more into a welded steel pipe of 50-55 mm in outer diameter.

(2) A step of roll-forming the welded steel pipe into a shaped pipe having an outer diameter of 34.0-38.0 mm and one or more concavities extending along an axial direction.

(3) A step of cutting the shaped pipe to a predetermined length.

(4) A step of swaging both ends of the cut shaped pipe.

(5) A step of sealing both ends (i.e. one end of the shaped pipe to be placed in a rockbolt-setting hole and the other end for introduction of a pressurized fluid) of the shaped pipe with sleeves.

(6) A step of forming a hole, which extends to an interior of the shaped pipe for introduction of a pressurized fluid, at a side wall of the sleeve.

PREFERRED EMBODIMENTS OF THE INVENTION

Figure 1:
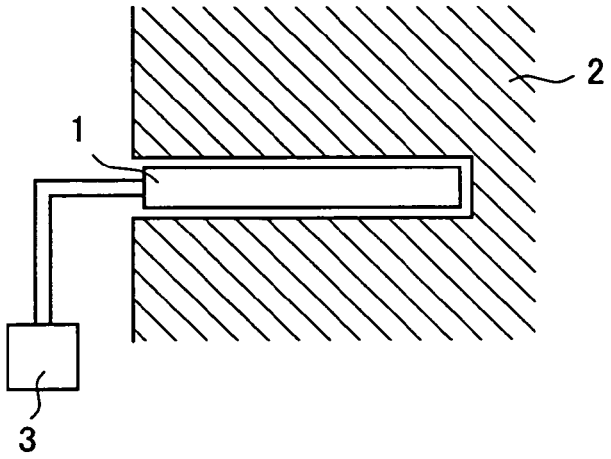
FIG. 1 is an explanatory view for reinforcement of a ground with an expanded rockbolt.

The inventive steel pipe rockbolt is manufactured from high-strength steel. Selection of the high-strength steel enables use of a thin steel sheet as material of the rockbolt. When a rockbolt formed from a thinner steel sheet is compared with a conventional rockbolt on the presumption that the rockbolts have the same outer diameter, a minimum bending radius of a curved part, which defines an axially extending concavity, is larger at a center along a radial direction. Strains, which are introduced into a steel pipe in a pipe-shaping process and hydraulic expansion of a shaped pipe, are reduced in a total amount as a decrease of thickness of the steel sheet. Due to reduction of the strains, the shaped pipe is hydraulically expanded without cracking. Use of the thinner steel sheet also means lightening of the rockbolt. Consequently, the inventive rockbolt is good of handlability and workability with high reliability.

Expansion of a concavity of the shaped pipe is initiated at a lower hydraulic pressure, as a rockbolt is thinner. Deformation of the shaped pipe continues at a lower hydraulic pressure even after initiation of expansion, so that a large volume of a pressurized fluid can be introduced into the shaped pipe without raising a load of a high-pressure pump. Consequently, hydraulic expansion is completed in a short time. In this respect, use of the thinner steel sheet as material of the rockbolt is advantageous for remarkable improvement of work efficiency.

For instance, a shaped pipe with a tensile strength of 400 $N/mm^2$, which has been used for a rockbolt with a yield strength of 170 kN, is manufactured by forming a steel sheet of 3 mm in thickness with a tensile strength of about 300 $N/mm^2$ and an elongation of about 35% to a welded steel pipe of 54 mm in outer diameter and reforming the welded pipe to a shaped pipe of 36 mm in outer diameter.

When a thin high-strength steel sheet is used as material for a 170 kN-class rockbolt, a strong and reliable rockbolt, which is hydraulically expanded without cracking, is obtained. In fact, a shaped pipe, which is manufactured by forming a high-strength steel sheet of 1.8-2.3 mm in thickness with a tensile strength of 490-640 $N/mm^2$ and an elongation of 20% or more to a welded pipe of 54 mm in outer diameter and then shaping the welded pipe to an objective profile of 36 mm in outer diameter, has a tensile strength of 530-690 $N/mm^2$. Consequently, a rockbolt, which is formed from the high-strength shaped pipe, is firmly fixed to a bedrock or ground with a strength of about 170 kN, by placing it in a rockbolt-setting hole of the bedrock or ground and hydraulically expanding it therein.

Use of a thinner steel sheet enables bending a surface part of a welded pipe with a larger bending radius in a pipe-shaping process. Presume that a cylindrical pipe of 54 mm in outer diameter is formed to a shaped pipe with a cross section shown in FIG. 2A, wherein a curved part (a concavity 4) has an outside bending radius of 5 mm. A shaped pipe, which is formed from a cylindrical pipe of 3 mm in thickness, has a curved part with an inside bending radius of 2 mm. On the other hand, a shaped pipe, which is formed from a cylindrical pipe of 2 mm in thickness, has a curved part with an inside bending radius of 3 mm. In short, as a decrease in thickness of a welded pipe (in other words, a steel sheet), a bending radius becomes larger, resulting in a reduction of cumulative strains during pipe-shaping. Reduction of the cumulative strains means an increase of a tolerance limit until the shaped pipe is cracked due to the accumulation of strains. Consequently, the inventive rockbolt is hydraulically expanded in a bedrock or ground without fears of bursting.

A thickness of a steel sheet is determined within a range of 1.8-2.3 mm in order to effectively reduce the accumulation of strains. If the thickness exceeds 2.3 mm, it is difficult to realize an increase of a bending radius in a pipe-shaping process. On the other hand, the thickness less than 1.8 mm means the necessity of a high-strength steel sheet with a tensile strength of 640 $N/mm^2$ or more, otherwise a strength of 170 kN or so would not be imparted to a rockbolt. However, such high-strength steel sheets can not be formed to an objective profile due to poor elongation in a pipe-shaping process, and shaped pipes useful as expansive rockbolts can not be manufactured with ease from welded steel pipes of 50-55 mm in outer diameter. Besides, steel sheets shall have a tensile strength of 490 $N/mm^2$ or more; otherwise rockbolts with 170 kN or so would not be manufactured from welded pipes of 50-55 mm in outer diameter. Elongation of 20% or more is also necessary, in order to hydraulic expand shaped pipes without bursting.

Figure 2A:
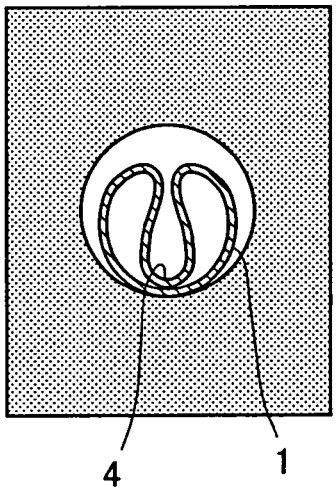
FIG. 2A is a sectional view illustrating a rockbolt, which is placed in a rockbolt-setting hole of a ground but not expanded yet.
Figure 2B:
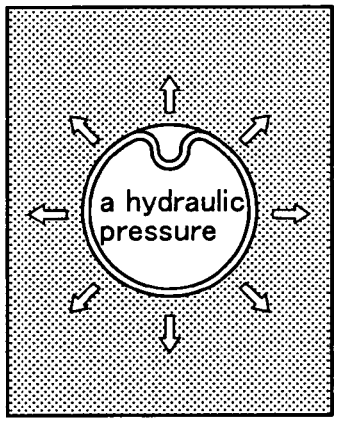
FIG. 2B is an explanatory view for application of a hydraulic pressure to a rockbolt during expansion.
Figure 2C:
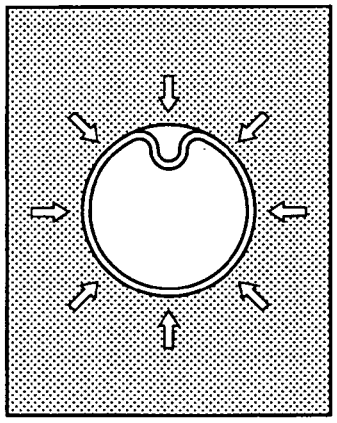
FIG. 2C is an explanatory view for application of a pressure to a rockbolt, which is completely expanded.

The expansive steel pipe rockbolt has a shaped pipe with a cross section, as shown in FIG. 2A. At least one concavity 4 extends along an axial direction of the shaped pipe. When a pressurized fluid is introduced into the shaped pipe, the shaped pipe is expansively returned to its original cylindrical profile by bulging of the concavity 4. On the presumption that shaped pipes have the same outer diameter and the same profile of the concavity 4, a larger pressure is necessary for bulging the concavity 4 as an increase in thickness of the shaped pipe. The thickness effect of the shaped pipe on bulging of the concavity 4 is explained as follows: A moment for re-bending a dented steel sheet to its original profile with hydraulic expansion is roughly estimated according to a formula of $(t^2b/4)\times\sigma_e$ (wherein t is thickness, b is width, and $\sigma_e$ is yield stress of the steel sheet), and the moment increases at a ratio in proportion to square thickness $t^2$.

In the case where an internal pressure of a vessel is raised to a predetermined value by introduction of a pressurized fluid into the vessel from a hydraulic pump, a large amount of the pressurized fluid flows from the pump into the vessel at a relatively lower inner pressure, but the flow rate is gradually reduced as an increase of the internal pressure. Accounting the relationship of the internal pressure with the flow rate, initiation of bulging of the concavity 4 at a lower pressure means inflow of a large amount of the pressurized fluid into the shaped pipe at a low-pressure stage until expansion of the shaped pipe. If expansion of the shaped pipe is initiated at a higher pressure on the contrary, an inflow rate of the pressurized fluid gradually decreases in correspondence with an increase of the internal pressure of the shaped pipe. In this case, it is unavoidable to continue introduction of the pressurized fluid for a long time until the internal pressure is raised to a value necessary for initiation of expansion.

Figure 3:
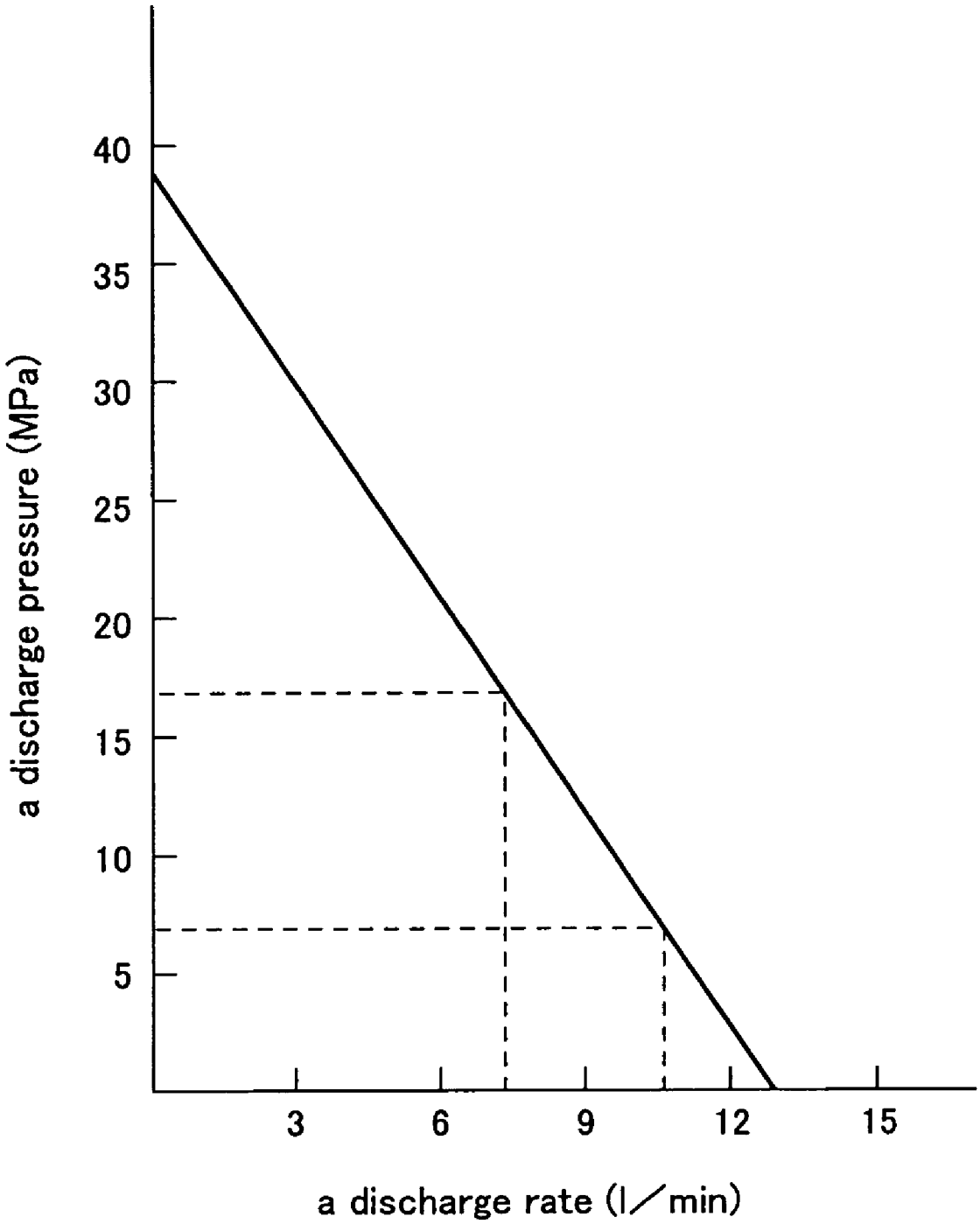
FIG. 3 is a graph showing performance of a hydraulic pump.

In fact, FIG. 3 shows a relationship between a discharge rate of high-pressure water and a discharge pressure, wherein air is supplied at a pressure of 0.6 MPa to a hydraulic pump with an air/water area ratio of 65/1. It is noted from the relationship that the inflow rate of the high-pressure water is gradually reduced as an increase of an internal pressure of a rockbolt and finally to 10.6 liters/minute at an internal pressure of 7 MPa.

Presume that a pressure of 7 MPa is necessary for initiation of bulging of the concavity 4, which is formed at a shaped pipe of 2 mm in thickness and that a pressure of 17 MPa is necessary for initiation of bulging of the concavity 4, which is formed at a shaped pipe of 3 mm in thickness. When a rockbolt is hydraulically expanded with a supply air pressure of 0.6 MPa under the above conditions, an inflow rate of the high pressure water is varied in correspondence with an internal pressure of the rockbolt as follows:

The shaped pipe of 2 mm in thickness starts expansion at a pressure of 7 MPa, but the shaped pipe of 3 mm in thickness does not start expansion at a pressure of 7 MPa. Expansion of the thicker shaped pipe is initiated, when the internal pressure reaches 17 MPa. A discharge rate of the high-pressure water is reduced to 7.2 litters/min at the internal pressure of 17 MPa.

Once the bulging of the concavity 4 starts, the expansive deformation of the shaped pipe continues at a pressure lower than the expansion-initiating pressure, and the expansion mode is substantially constant regardless of the thickness of the shaped pipe. After the shaped pipe is expanded to a size corresponding to an inner diameter of a rockbolt-setting hole in a bedrock or ground, an additional pressure is further applied to the expanded rockbolt so as to press the expansively deformed pipe onto an inner wall of the rockbolt-setting hole.

Although the thinner shaped pipe is expansively deformed by an internal pressure of 7 MPa, the internal pressure is necessarily raised to 17 MPa for the expansive deformation of the thicker shaped pipe. Injection of high-pressure water shall be continued at a discharge rate corresponding to a discharge pressure of 7-17 MPa. As a result, a hydraulic pump shall be compensatorily driven for a longer time. Moreover, a pressure for further expansive deformation is higher compared with the thinner shaped pipe, so that it is obliged to inject high-pressure water in a higher discharge pressure region, in other words, a small discharge rate region, for continuation of the expansive deformation of the thicker shaped pipe. In short, a time period for hydraulic expansion of the thicker shaped pipe is longer than that for the thinner shaped pipe. The completion of expansive deformation in a short time is also the advantage originated in the thinner rockbolt made of high-strength steel.

The inventive rockbolts are manufactured from high-strength steel sheets by the following steps:

A high-strength steel sheet of 1.8-2.3 mm in thickness with predetermined mechanical properties is processed into a welded pipe having an outer diameter of 50-55 mm by a conventional pipe-making process using high frequency welding, laser welding, TIG welding or the like. The welded pipe is roll-formed to a shaped pipe having an outer diameter of 34-38 mm and a dented sectional profile defined by a circumferential part and a concavity.

A roll-forming process, proposed by JP 2003-145216 A, is suitable for forming the welded pipe to the shaped pipe. But, an extrusion or press-forming process may be also employed, instead of the roll-forming.

Figure 4:
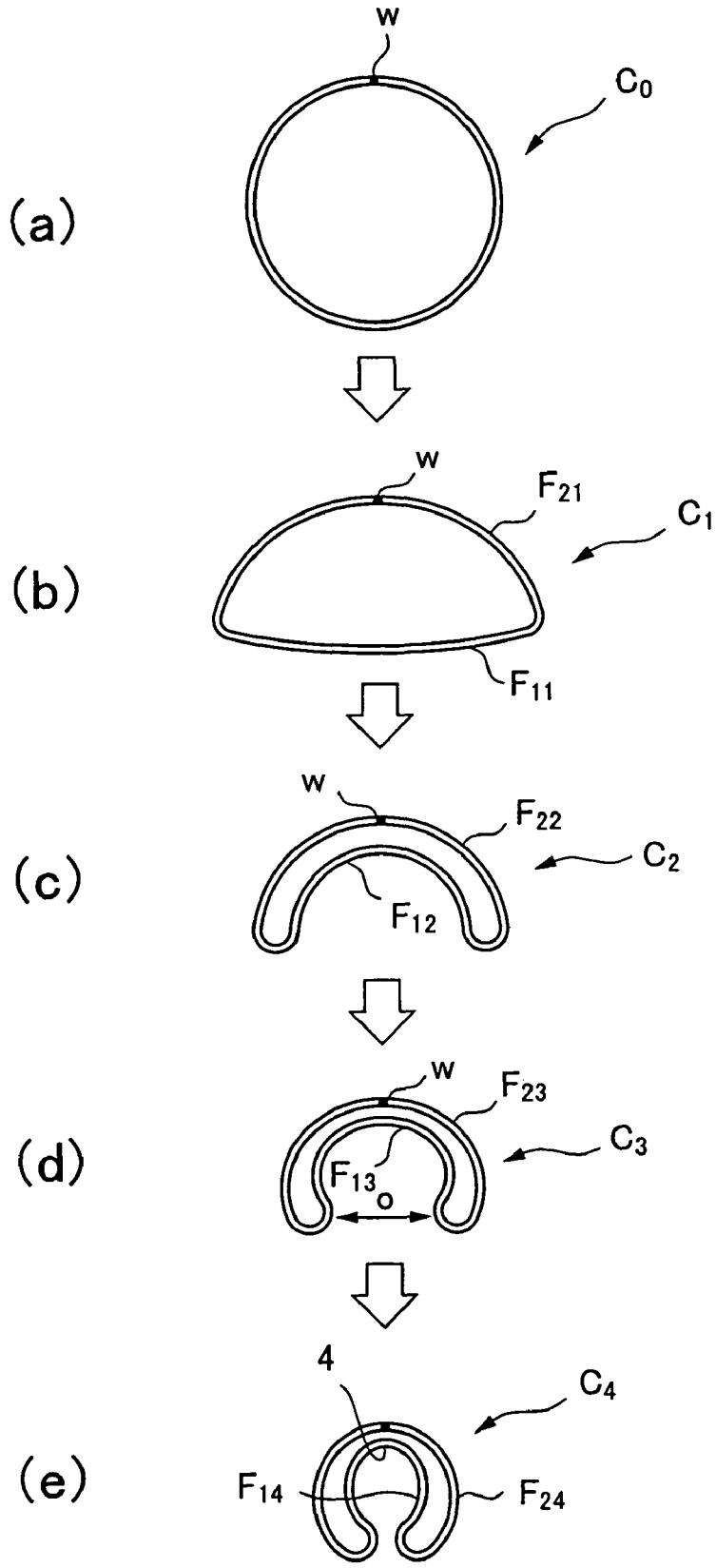
FIG. 4 is an explanatory view showing changes of a sectional profile of a pipe in response to shaping steps.

According to the roll-forming process, a sectional profile of a welded pipe is reformed step by step, as shown in FIG. 4.

At first, a welded pipe with a circular profile (FIG. 4*a*) is prepared by a high frequency welding method or the like.

Figure 5:
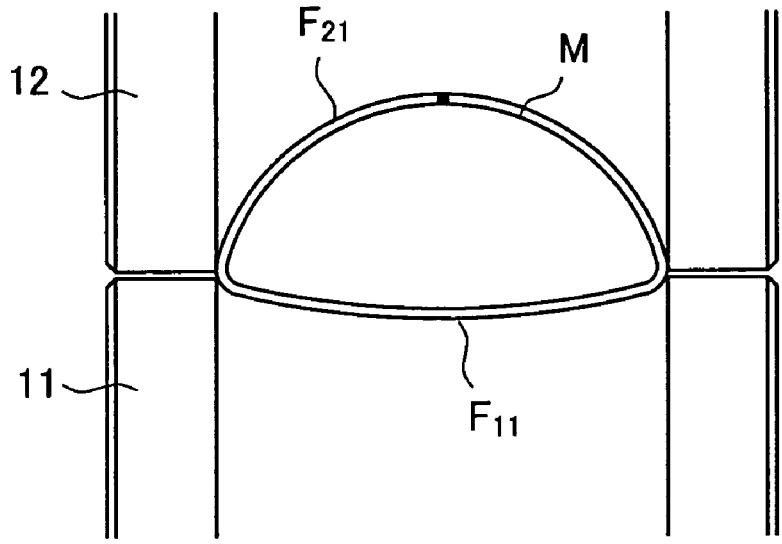
FIG. 5 is a schematic view illustrating profiles of forming rolls, which are used at a first step of a pipe-shaping process.

The welded pipe is roll-formed to a sectional profile $C_1$ (FIG. 4*b*) comprising a convex surface $F_{11}$ with a large radius of curvature and another convex surface $F_{21}$ with a small radius of curvature. The convex surface $F_{11}$ has a circumferential length corresponding to a circumferential length of a part of an objective shaped pipe including a concavity 4. The other convex surface $F_{21}$ has a circumferential length corresponding to a circumferential length of the other part of the objective shaped pipe. These convex surfaces $F_{11}$ and $F_{21}$ are formed by a rolling stand equipped with a couple of forming rolls 11 and 12 having concave profiles with a radius of curvature different from each other, as shown in FIG. 5. A multi-stage rolling stand may be also employed for successively changing radii of curvatures of the convex surfaces $F_{11}$ and $F_{21}$.

Concave profiles of the forming rolls 11 and 12 are transcribed to the welded pipe M, by passing the welded pipe M through a gap between the forming rolls 11 and 12. That is, a circular profile $C_0$ (FIG. 4*a*) is reformed to a sectional profile $C_1$ (FIG. 4*b*) comprising the convex surface $F_{11}$ with a large radius of curvature and the convex surface $F_{21}$ with a small radius of curvature.

Figure 6:
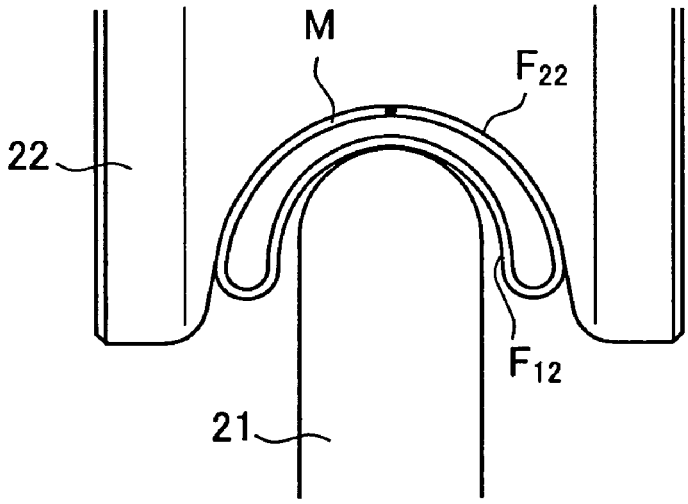
FIG. 6 is a schematic view illustrating profiles of forming rolls, which are used at a second step of a pipe-shaping process.

In the second roll-forming step, a disc roll 21 (FIG. 6) having an edge with a small radius of curvature is pressed onto a center of the convex surface $F_{11}$, so as to dent the convex surface $F_{11}$ inwards, as shown in FIG. 4*c*. A rolling stand in the second roll-forming step is equipped with a forming roll 22, which has a concave profile with a radius of curvature smaller than the concave profile of the forming roll 12 in the first roll-forming step, in addition to the disc roll 21, as shown in FIG. 6. A multi-stage rolling stand may be also employed for making radii of curvatures successively smaller.

When the welded pipe M is passed though a gap between the disc roll 21 and the concave roll 22 in the manner that the disc roll 21 is pressed onto a center of the convex surface $F_{11}$, the center of the convex surface $F_{11}$ is dented inwards, so that the welded pipe M is reformed to a sectional profile $C_2$ (FIG. 4*c*) having a guttered curved part $F_{12}$ extending along an axial direction. The other curved part $F_{22}$, which defines an external profile of a shaped pipe, keeps an initial radius of curvature of the welded pipe M.

Figure 7:
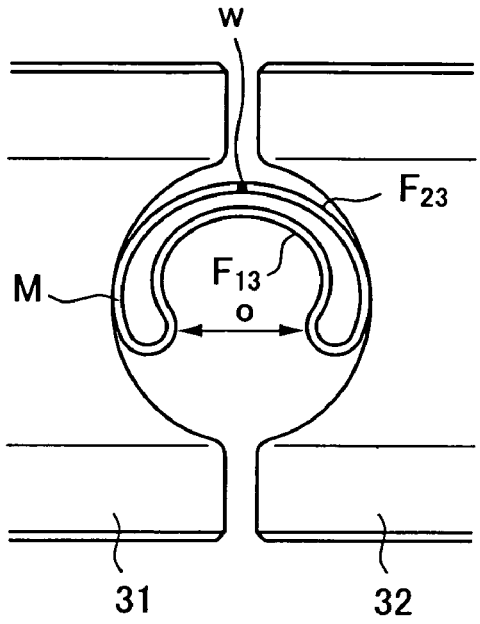
FIG. 7 is a schematic view illustrating profiles of forming rolls, which are used at a third step of a pipe-shaping process.

Since an expansively deformed pipe is pressed onto an inner wall of a rockbolt-setting hole in a bedrock or ground for reinforcement, the inner diameter of the rockbolt-setting hole is larger than an outer diameter of a shaped pipe but smaller than an outer diameter of the welded pipe M. Therefore, the sectional profile $C_2$ is reformed to a small diameter profile $C_3$ in the third roll-forming step. A rolling stand in this step is equipped with a couple of forming rolls 31 and 32 having concave profiles with a radius of curvature smaller than the initial diameter of the welded pipe M, as shown in FIG. 7. Of course, a multi-stage rolling stand may be also used for making the radius of curvature successively smaller in the third roll-forming step.

When the pipe with the sectional profile $C_2$ is passed through a gap between the rolls 31 and 32, the convex surface $F_{22}$ is curved to a circular profile $F_{23}$ with a small radius of curvature so as to narrow an opening (o) in correspondence to concave profiles of the rolls 31 and 32, as shown in FIG. 4*d*. In response to the reformation of the convex surface $F_{22}$, the guttered concavity part $F_{12}$ is also reformed to a small diameter concavity part $F_{13}$. In the third roll-forming step, the welded pipe M is preferably rotated by 90 degrees around its axis from a positional relationship with the rolls 11 and 12 in the first step or with the rolls 21 and 22 in the second step to such a position that the opening (o) and the weld bead (w) are disposed between the rolls 31 and 32. Due to the 90 degree rotation, a forming pressure is uniformly applied from the rolls 31 and 32 to the convex surface $F_{22}$, so that the sectional profile $C_2$ is reformed to a circular profile $C_3$ comprising an inner part $F_{13}$ and a circumferential part $F_{23}$, both of which have uniform radii of curvature, as shown in FIG. 4*d*.

Figure 8:
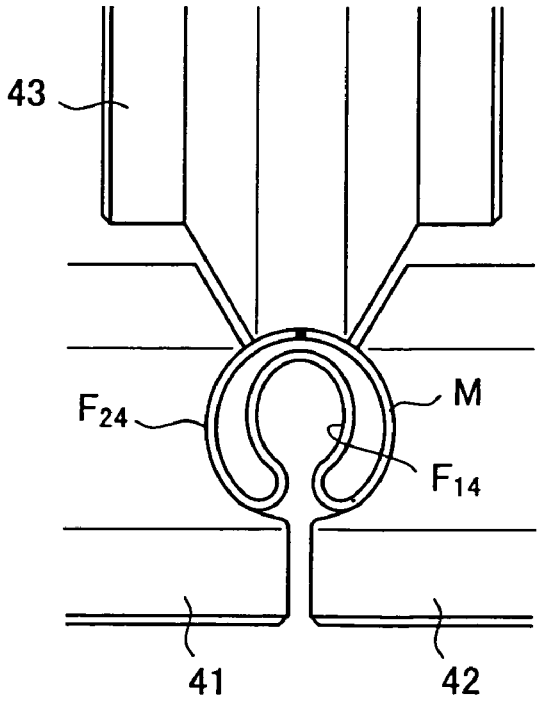
FIG. 8 is a schematic view illustrating profiles of forming rolls, which are used at a forth step of a pipe-shaping process.

The sectional profile $C_3$ with a narrowed opening (o) is dressed to a circular profile $C_4$ having an outer diameter smaller than an inner diameter of a rockbolt-setting hole in a bedrock or ground, in the fourth roll-forming step. A rolling stand in this step preferably has a pressing roll 43 in addition to a couple of forming rolls 41 and 42, as shown in FIG. 8. A multi-stage rolling stand may be also used for successively reforming the sectional profile $C_3$ to the small diameter profile $C_4$.

When a forming pressure is applied from the rolls 41, 42 to the convex surface $F_{22}$ in the manner that the roll 43 is pressed onto the center of the circumferential part $F_{22}$, the welded pipe M is stationarily held at a predetermined positional relationship during roll-forming, so as to ensure uniform reformation of the convex surface $F_{22}$ until a quasi-double sectional profile $C_4$ is formed by the outer periphery $F_{24}$ and the inner periphery $F_{14}$ with the opening (o) being nearly closed. During roll-forming, escape of the circumferential part $F_{23}$ from the gap is inhibited by the pressing roll 43, so that the welded pipe M is formed to an objective small diameter profile $C_4$ without flattening.

The shaped pipe with the objective profile $C_4$ is sized to a predetermined length and sealed at both ends.

A front end of the shaped pipe is sealed as follows:

A part of 80 mm in longitudinal length from the front end is swaged to a size of 32-34 mm in outer diameter. A sleeve of 36-40 mm in outer diameter, 2.0-3.0 mm in thickness and 60-80 mm in length is fixed to the swaged end part. A punch is pressed into an open end of the shaped pipe so as to reform the end part to a flat shape corresponding to a collet of the punch, and the pressed end part is sealed by welding.

The opposite end of the shaped pipe is designed for introduction of a pressurized fluid and sealed as follows:

A part of 80 mm in longitudinal length from the opposite end is swaged in the same way. A sleeve of 40-42 mm in outer diameter, 3.5-4.5 mm in thickness and 60-80 mm in length is fixed to the swaged end part. A punch is pressed into an open end of the shaped pipe so to reform the end part to a flat shape corresponding to a collet of the punch, and the pressed end part is sealed by welding. The sleeve preferably has a circumferential groove for firmly chucking a rockbolt embedded in a bedrock or ground for pullout test.

After both ends are sealed, a hole for introduction of a pressurized fluid into the interior of the shaped pipe is formed by drilling the sleeve at the opposite end. A position of the hole is determined at a part slightly apart from the end of the sleeve.

Rockbolts embedded in a bedrock or ground are exposed to corrosive atmospheres of from acid to alkali in response to humidity, water quality, ventilation and so on. Accounting the atmospheres, coated steel pipes, which have plating layers formed on inner and outer surfaces, are appropriate material for corrosion-resistant and durable rockbolts in the bedrock or ground. Such coated steel pipes are offered by a pre-coating or post-coating process, but pre-coated steel pipes, which are manufactured from coated steel sheets, are profitable in respect to productivity.

A plating layer may be Zn, Zn—Al or Zn—Al—Mg. A Zn plating layer is preferably formed on a steel base by immersing a steel strip in molten zinc containing 0.1-0.2% of Al, which suppresses growth of a Fe—Zn alloy layer harmful on workability. A Zn—Al plating layer, e.g. Zn-5% Al or Zn-55% Al, exhibits corrosion-resistance 2-4 times better than a Zn plating layer of the same thickness. A Zn—Al—Mg plating layer is hard and exhibits the optimum corrosion-resistance, so that a rockbolt coated with the hard Zn—Al—Mg plating layer is placed and expanded in a bedrock or ground without scratches caused by abrasion with the bedrock or collision of scatters. Scratching is also inhibited during handling or transporting the coated rockbolt. Since scratches, which act as starting points of corrosion, are scarcely formed, the embedded rockbolt maintains good durability and reliability in addition to the excellent corrosion-resistance even in a corrosive environment.

The Zn—Al—Mg plating layer may be thinned to 3-30 μm due to excellent corrosion-resistance and hardness. The Zn—Al—Mg plating layer contains 0.05-10% Mg, 4-22% Al. It may further contain 0.001-0.1% Ti, 0.0005-0.045% B and/or 0.005-2.0% at least one selected from the group consisting of rare earth metals, Y, Zr and Si.

An element Mg is incorporated in a zincic corrosion product, which is formed on a surface of the plating layer. The Mg-containing zincic corrosion product together with an element Al in the plating layer reduces a corrosion rate of the plating layer in a soil environment. Since a part of the Mg-containing zincic corrosion product also flows into a weld bead and a cut edge in a process of manufacturing a pre-coated steel pipe, the weld bead and the cut edge are also prevented from corrosion. Moreover, when a welded part is repaired by thermal spraying, the Mg-containing zincic corrosion product flows onto a sprayed layer or into a corrosion product on the sprayed layer, resulting in protection of a steel base from corrosion. Mg is also important for hardening the plating layer by formation of a Zn—Mg intermetallic compound. These effects are achieved by controlling a Mg content within a range of 0.05-10% (preferably 1-4%).

The other element Al is converted to a clinging Zn—Al corrosion product effective as a corrosion inhibitor. Zn/Al/$Zn_2Mg$ ternary eutectic grains appear in a solidified plating layer due to presence of Al. The ternary eutectic grains have a microstructure finer than Zn/$Zn_2Mg$ binary eutectic grains and raise hardness of the plating layer. An Al content of 4% or more is necessary for formation of the clinging Zn—Al corrosion product and the Zn/Al/$Zn_2Mg$ ternary eutectic grains. However, an increase of the Al content raises a melting temperature of a plating metal and needs holding a hot-dip bath at an elevated temperature, resulting in poor productivity. In this sense, an upper limit of the Al content is determined at 22%.

Optional elements Ti and B impedes formation of a $Zn_{11}Mg_2$ phase harmful on an external appearance of a coated steel sheet, so that Zn—Mg intermetallic precipitates present in a plating layer are substantially composed of $Zn_2Mg$. The effect of Ti on inhibiting formation of the $Zn_{11}Mg_2$ phase is apparently noted by 0.001% or more (preferably 0.002% or more) of Ti. However, excess Ti above 0.1% promotes growth of a Ti—Al precipitate, resulting in a rugged surface of the plating layer with poor external appearance.

Formation of the $Zn_{11}Mg_2$ phase is also impeded by addition of B at a ratio of 0.0005% or more (preferably 0.001% or more). But, excess B above 0.045% promotes growth of Ti—B and Al—B intermetallic compounds, which degrade a smooth surface and external appearance of a plating layer.

A rockbolt, which is prepared from a steel pipe hot-dip coated with a Zn—Al—Mg plating layer containing Al and Mg at relatively large ratios, often reduces its surface gloss. As reduction of the surface gloss, a surface of the plating layer is changed from a fine metallic luster to gray with the lapse of time. As a result, the rockbolt decreases its commercial value. Reduction of the surface gloss is prevented by adding at least one oxidizable element selected from the group consisting of rare earth metals, Y, Zr and Si at a ratio of 0.005% or more. However, a maximum ratio of the oxidizable element is determined at 2.0%, since its effect on reduction of the surface gloss can not be expected any more by excess addition above 2.0%.

A Fe—Al intermetallic compound, harmful on workability and formability of the coated steel sheet or pipe, is more formed as an increase of Al in the Zn—Al—Mg plating layer. The Fe—Al intermetallic compound at a boundary between a base steel and a plating layer unfavorably causes peeling-off of the plating layer during working or forming of a coated steel sheet or pipe. Formation of the intermetallic compound is inhibited by inclusion of Si at a small ratio in the plating layer.

EXAMPLES

A high-strength steel sheet of 2.1 mm in thickness with a tensile strength of 490 N/mm$^2$ and an elongation of 28% was processed into a welded pipe of 54 mm in outer diameter. The welded pipe was roll-formed to a shaped pipe of 36 mm in outer diameter with a sectional profile, as shown in FIG. 2A, having a concavity 4 extending along an axial direction. The shaped pipe had a tensile strength of 550 N/mm$^2$.

The shaped pipe was sized to a length of 4 m. End parts in longitudinal length of 75 mm from the edges of the sized pipe were swaged to a profile of 33.1 mm in outer diameter. A sleeve of 33.1 mm in inner diameter, 38.1 mm in outer diameter, 2.5 mm in thickness and 70 mm in length was fixed to one end part, and the end part was sealed with the sleeve by welding. Another sleeve of 33.1 mm in inner diameter, 41.1 mm in outer diameter, 4.0 mm in thickness and 70 mm in length was fixed to the opposite end part at a side for introduction of a pressurized fluid, and the end part was sealed with the sleeve by welding.

After the ends were both sealed, a side wall of the latter sleeve was drilled so as to form a hole of 3.0 mm in diameter leading to an interior of the shaped pipe.

As a comparative example, a rockbolt was manufactured from a steel sheet of 3.0 mm in thickness with tensile strength of 300 N/mm$^2$ and elongation of 35% by processing the steel sheet to a welded pipe of 54 mm in outer diameter and then roll-forming the welded pipe to a shaped pipe of 36 mm in outer diameter under the same conditions.

A seal head for hydraulic expansion was attached to each of the inventive and comparative rockbolts, and high-pressure water was injected into an interior of the shaped pipe by a hydraulic pump. The shaped pipe was hydraulically expanded. Expansive deformation was investigated in detail.

The inventive rockbolt started expansive deformation, i.e. bulging of the concavity 4 (FIG. 2A), when a hydraulic pressure in the shaped pipe reached 7 MPa. Once the expansive deformation occurred, it continued at a hydraulic pressure of 5 MPa. During propagation of the expansive deformation, high-pressure water was injected into the shaped pipe at a flow rate of 11.3 litters/minute, and the expansive deformation was completed in 31 seconds.

On the other hand, the concavity 4 of the comparative rockbolt did not expansively reverse at a hydraulic pressure of 7 MPa, but the expansive deformation started when the hydraulic pressure reached 17 MPa. A hydraulic pressure necessary for continuation of the expansive deformation was 10 MPa. A feed rate of the high-pressure water at the hydraulic pressure of 10 MPa was only 9.6 litters/minute, and 41 seconds were spent for completion of the expansive deformation.

It is noted from the comparison that the inventive rockbolt completes expansive deformation in a time period about ¾ shorter than a conventional rockbolt. The short expansion time leads to a remarkable decrease in a term of works in practical reinforcement works wherein hundreds or thousands of rockbolts are to be embedded in a bedrock. Moreover, the expansion state is achieved by a relatively lower hydraulic pressure, so as to reduce a load applied to a hydraulic pump.

Rockbolts, which were hydraulically expanded with an assumption of placement in a construction site, were subjected to pullout test. Test results prove that the inventive rockbolts had strength of about 170 kN. Since the inventive rockbolts were thinned and lightened by about 30% compared with conventional rockbolts, transportation to or handling in a construction site becomes easy. Furthermore, shaped pipes, which are prepared from welded pipes with less accumulation of strains, are expansively deformed to objective profiles without bursting caused by introduction of strains during hydraulic expansion, resulting in safety of rock bolting works.

The invention claimed is:

1. A high-strength steel pipe rockbolt comprising an expansive rockbolt main body made from a shaped pipe having one or more concavities extending along an axial direction, the shaped pipe being made by forming a high-strength steel sheet having a thickness of 1.8-2.3 mm, a tensile strength of 490-640 N/mm$^2$ and an elongation of at least 20%.

2. The high-strength steel pipe rockbolt as defined in claim 1, wherein the shaped pipe is coated with a Zn, Zn—Al or Zn—Al—Mg plating layer.

3. The high-strength steel pipe rockbolt as defined in claim 2, wherein the shaped pipe is coated with a Zn, Zn—Al or Zn—Al—Mg plating layer.

4. The high-strength steel pipe rockbolt as defined in claim 1, wherein the shaped pipe made by forming the high-strength steel sheet has a tensile strength of 530-690 N/mm$^2$ and an elongation of at least 20%.

5. The high-strength steel pipe rockbolt as defined in claim 1, wherein the shaped pipe is coated with a Zn—Al—Mg plating layer containing 0.05-10% of Mg and 4-22% of Al.

6. The high-strength steel pipe rockbolt as defined in claim 5, wherein the Zn—Al—Mg plating layer further contains 0.001-0.1% of Ti and 0.0005-0.045% of B.

7. The high-strength steel pipe rockbolt as defined in claim 6, wherein the Zn—Al—Mg plating layer further contains 0.005-2.0% of at least one selected from the group consisting of rare earth metals, Y, Zr and Si.

8. The high-strength steel pipe rockbolt as defined in claim 5, wherein the Zn—Al—Mg plating layer further contains 0.005-2.0% of at least one selected from the group consisting of rare earth metals, Y, Zr and Si.

9. A method of manufacturing a steel pipe rockbolt involving the steps of:

(1) processing a steel sheet of 1.8-2.3 mm in thickness with a tensile strength of 490-640 N/mm$^2$ and an elongation of at least 20% into a welded pipe of 50-55 mm in outer diameter;

(2) roll-forming the welded pipe to a shaped pipe of 34.0-38.0 mm in outer diameter having a first end and a second end and one or more concavities extending along an axial direction;

(3) sizing the shaped pipe to a predetermined length;

(4) swaging the first end and the second end of the sized shaped pipe;

(5) hermetically fixing sleeves to the first end and the second end of the shaped pipe, the first end being a top to be inserted into a rockbolt-setting hole in a bedrock or ground, and the second end being a site for introduction of a pressurized fluid; and (6) drilling the sleeve at the second end for formation of a pressure fluid inlet leading to an interior of the shaped pipe.

* * * * *